US007028598B2

(12) United States Patent
Teshima

(10) Patent No.: US 7,028,598 B2
(45) Date of Patent: Apr. 18, 2006

(54) APPARATUS FOR LONGITUDINALLY PERFORATING A WEB OF PAPER IN A ROTARY PRINTING PRESS

(75) Inventor: Tsunetoshi Teshima, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/329,337

(22) Filed: Dec. 27, 2002

(65) Prior Publication Data

US 2003/0177918 A1 Sep. 25, 2003

(30) Foreign Application Priority Data

Mar. 22, 2002 (JP) ..... 2002-081047

(51) Int. Cl.
*B26D 3/08* (2006.01)

(52) U.S. Cl. ..... 83/879; 83/436.1; 83/436.15; 83/436.3; 83/436.7; 493/363; 493/365

(58) Field of Classification Search ..... 83/436.1, 83/563, 304, 305, 879, 866, 867, 927, 436.15, 83/436.3, 436.6, 436.7, 431, 695, 408, 508.2, 83/477.1, 469, 887, 425, 886, 436.75; 493/363, 493/365, 370, 471; 101/224–225
See application file for complete search history.

(56) References Cited

U.S. PATENT DOCUMENTS 123,723 A * 2/1872 Ohm ..... 83/431
852,375 A * 4/1907 Carlton ..... 83/879
1,258,599 A * 3/1918 Moore ..... 83/176
2,821,915 A * 2/1958 Katz ..... 101/226

(Continued)

FOREIGN PATENT DOCUMENTS

JP 05-201611 A1 8/1993
JP 06-015596 1/1994
JP 06-072066 A1 3/1994

(Continued)

*Primary Examiner*—Allan N. Shoap
*Assistant Examiner*—Omar Flores Sánchez
(74) *Attorney, Agent, or Firm*—Rader, Fishman & Grauer PLLC

(57) ABSTRACT

A rotary printing press has a folding station where the printed web is perforated both transversely and longitudinally in order to expedite subsequent folding thereof into signatures. In order to incorporate a longitudinal perforator into the folding station without adding to its size, a longitudinally perforating blade similar to a circular saw is mounted to a blade carrier shaft which is rotatably supported opposite a feed roller by which the web is frictionally fed into and through the folding station. An annular, longitudinally grooved anvil is formed circumferentially on the feed roller for engaging the longitudinally perforating blade via the web being thereby perforated. The longitudinally perforating blade is movable with the blade carrier shaft into and out of perforating engagement with the anvil on the feed roller.

5 Claims, 6 Drawing Sheets

U.S. PATENT DOCUMENTS 3,152,501 A * 10/1964 Nassar ..... 83/308
3,768,101 A * 10/1973 Kuts ..... 83/408
3,855,890 A * 12/1974 Lynch et al. ..... 83/331
4,159,661 A * 7/1979 Russell et al. ..... 83/305
4,524,962 A * 6/1985 Davenport et al. ..... 270/21.1
4,597,820 A * 7/1986 Nozaka ..... 156/353
4,757,732 A * 7/1988 Arima ..... 83/425.2
5,045,045 A * 9/1991 Davenport et al. ..... 493/363
5,131,901 A * 7/1992 Moll ..... 493/355
5,229,827 A * 7/1993 Sato et al. ..... 399/385
5,826,474 A * 10/1998 Howard et al. ..... 83/105
6,128,989 A * 10/2000 Jones et al. ..... 83/156

FOREIGN PATENT DOCUMENTS

JP 10-114048 A1 5/1998

* cited by examiner

APPARATUS FOR LONGITUDINALLY PERFORATING A WEB OF PAPER IN A ROTARY PRINTING PRESS

BACKGROUND OF THE INVENTION

1. Field of the Invention

This invention relates generally to printing presses, to web-fed printing presses, and to improvements in the construction of a folding station customarily appended to a web-fed printing press for cutting and folding the printed web into multiple-page signatures. More particularly, the invention deals with a perforator incorporated in the folding station for creating a series of incisions longitudinally and medially of the web description of the Prior Art, in order to expedite the subsequent folding of the web.

2. Description of the Prior Art

The art of longitudinally perforating the printed web of paper, and folding the same along the series of perforations, at the folding station (shown in FIG. 1 of the drawings attached hereto) of the rotary printing press has been known and practiced extensively. Japanese Patent No. 3,034,702 represents a typical prior art device directed to the art, teaching use of a pair of cylinders placed opposite each other via the web. One of the cylinders carries a perforating tool, a sawtooth-edged perforating blade of annular shape arranged circumferentially thereon, and the other a bed or anvil with a groove therein to receive the sawtooth edge of the perforating blade via the web. The opposed pair of the blade cylinder and anvil cylinder are positioned between a former, by which the printed web is doubled along its longitudinal centerline, and an opposed pair of a folding cylinder and jaw cylinder by which the doubled web is cut transversely and again folded into eight-page signatures.

This prior art device is objectionable, among other reasons, for its large space requirement. Placed as above between the former and the folding and jaw cylinders, the blade cylinder and anvil cylinder make the folding station, and therefore the complete printing press system, inordinately bulky.

This drawback is absent from Japanese Unexamined Patent Publication No. 10-114,048, which suggests use of one blade cylinder and one anvil cylinder for both transversely and longitudinally perforating the web. The singular blade cylinder carries on its surface both a transversely perforating blade, which extends linearly along the cylinder axis, and a longitudinally perforating blade of annular shape extending circumferentially. The singular anvil cylinder has formed on its surface both an anvil of linear shape for the transversely perforating blade, and another anvil of annular shape for the longitudinally perforating blade. The web is therefore perforated both transversely and longitudinally as it passes between these dual blade cylinder and dual anvil cylinder.

Although so simple and compact in construction, this second prior art device has a serious inconvenience arising from the fact that not all the printings are necessarily perforated longitudinally besides being perforated transversely. The longitudinally perforating blade must therefore be detached from the blade cylinder when the web needs only transverse perforation, and remounted when it needs both transverse and longitudinal perforations.

Japanese Patent No. 3,166,087 utilizes preexisting feed roller means which lie between the noted former and the noted pair of folding cylinder and jaw cylinder in order to feed the web into and through the folding station. The feed roller means include one feed roller and, held against this feed roller, a pair of nip rollers of smaller size which are mounted on a common shaft with an axial spacing therebetween. A longitudinally perforating blade is mounted on the nip roller shaft, and an associated anvil on the drive roller.

An objection to this patent concerns the fact that the nip roller pair together with their supporting shaft are jointly movable toward and away from the drive roller in order to adjust to the variable thickness of the web traveling therebetween. As a result, according to this prior art device, the longitudinally perforating blade on the nip roller shaft incised the web to a variable depth depending upon the thickness of the web, sometimes failing to create perforations of sufficient size for the web to be subsequently folded correctly.

SUMMARY OF THE INVENTION

The present invention has it as an object to incorporate a longitudinal web perforator into the folding station of a web-fed printing press without adding to the size of the machine.

Another object of the invention is to make it unnecessary to dismount, and subsequently remount, the longitudinal web perforator in cases where the web does not need longitudinal perforation.

Still another object of the invention is to make the longitudinal web perforator independently adjustable to the variable thickness of the web, always cutting sufficiently deep into it in order to assure infallible folding of the web along the perforations.

Stated in its perhaps broadest aspect, this invention concerns an apparatus for longitudinally perforating a paper web or like material at a folding station of a rotary printing press. Included is a rotary, longitudinally perforating blade rotatably supported opposite a feed roller which forms part of feed means for feeding the web into and through the folding station. An anvil is formed on the feed roller for engaging the perforating blade via the web being thereby perforated. The perforating blade is moved by retractor means into and out of perforating engagement with the anvil on the feed roller.

In a preferred embodiment the feed means additionally include a pair of nip rollers movable into and out of rolling engagement with the feed roller via the web in positions spaced apart from each other axially of the feed roller. Positioned between this pair of nip rollers, the perforating blade is mounted to a rotary blade carrier shaft for joint travel therewith into and out of perforating engagement with the anvil on the feed roller, totally independently of the feed means.

Thus the longitudinal perforator means according to the invention are compactly incorporated with the preexisting web feed means without adding to the size of the folding station. The perforating blade itself is nevertheless movable toward and away from the feed roller independently of the pair of nip rollers and associated means. Consequently, although the nip rollers may vary their positions relative to the feed roller according to the thickness of the web, the blade can be urged by the retractor means toward the feed roller to incise the web thickness to a required depth. The web of variable thickness will therefore be invariably perforated and folded properly.

The longitudinally perforating blade must be retracted away from the feed roller not only when the web is threaded through the folding station preliminary to each printing assignment, but, as has been mentioned, when the web does not need longitudinal perforation. Employed for blade retraction in the preferred embodiment of the invention are a pair of fluid-actuated cylinders under the control of a solenoid valve, so that all that the operator has to do is to actuate this valve as by the manipulation of a hand switch.

The above and other objects, features and advantages of this invention and the manner of realizing them will become more apparent, and the invention itself will best be understood, from a study of the following description and appended claims, with reference had to the attached drawings showing the preferred embodiment of the invention.

DESCRIPTION OF THE PREFERRED EMBODIMENT

Folding Station

Figure 1:
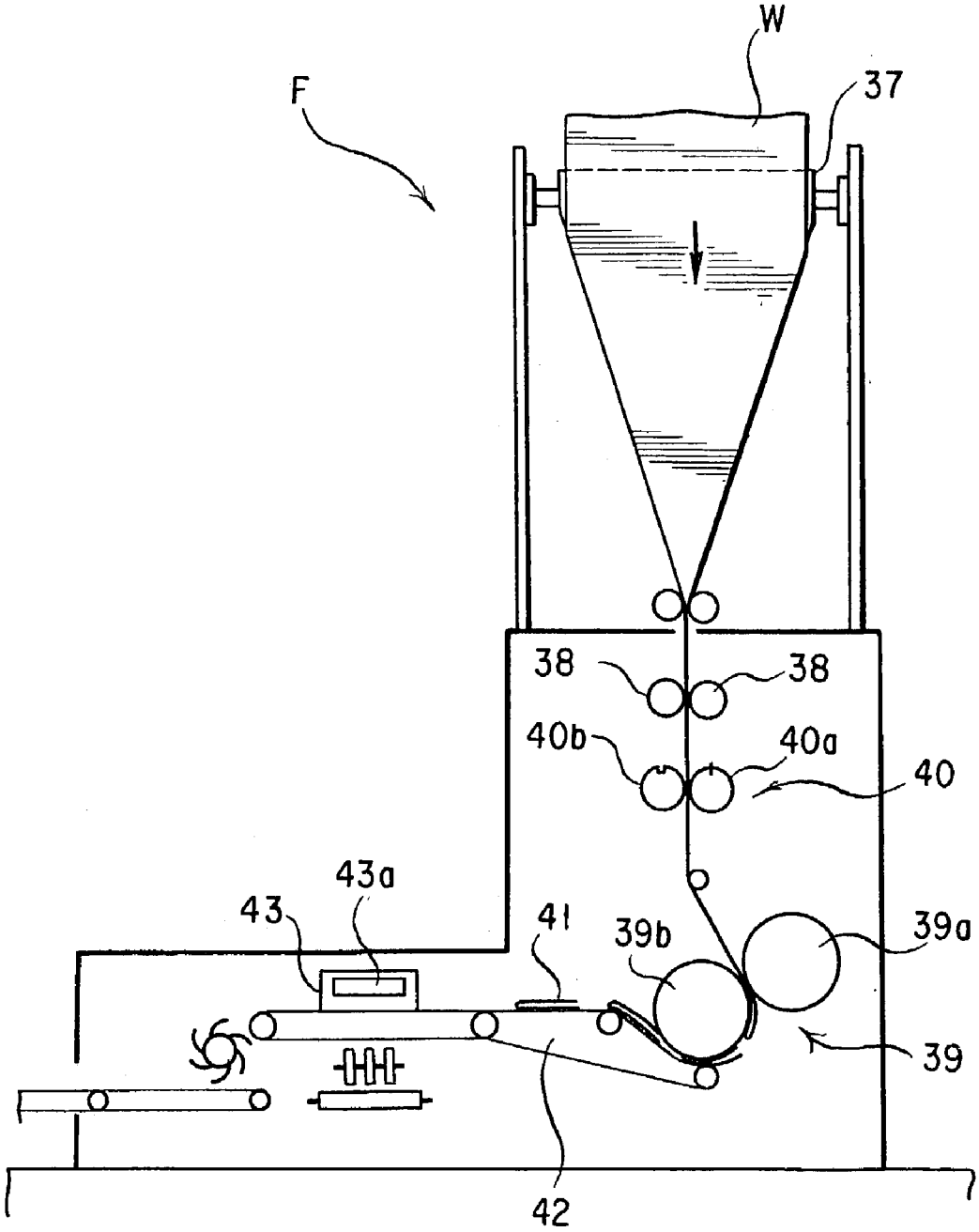
FIG. 1 PRIOR ART
FIG. 1 is a diagrammatic side elevation of the known folding station of a web-fed printing press suitable for incorporating the longitudinally perforating means according to the invention.

It will redound to a full appreciation of the advantages of the instant invention to show and describe the general configuration of the folding station of a web-fed printing press. FIG. 1 shows the printed web of paper W traveling down the folding station F. Positioned most upstream of the folding station F is a former 37 by which the web W is longitudinally doubled over itself. The doubled web W passes via a pair of feed rollers 38 to a transverse perforator 40 comprising a transverse perforating blade cylinder $\mathbf{40}_a$ and an associated anvil cylinder $\mathbf{40}_b$. As the web W passes between these cylinders $\mathbf{40}_a$ and $\mathbf{40}_b$, the transverse perforator 40 creates successive rows of perforations transversely of the web at constant longitudinal spacings. The web W is to be subsequently folded again along these transverse perforations into eight-page signatures.

Disposed downstream of the transverse perforator 40, a cutter/folder mechanism 39 comprises a cutting cylinder $\mathbf{39}_a$ for cutting the folded web W into successive predetermined lengths of individual sections and pushing each section along its perforated median line off the cylinder surface. A jaw cylinder $\mathbf{39}_b$ is positioned opposite the cutting cylinder $\mathbf{39}_a$ for receiving the pushed midpart of each section and creasing and folding the same along the transverse perforations into an eight-page signature. The successive eight-page signatures are deposited as at 41 on a conveyor 42 extending horizontally from under the jaw cylinder $\mathbf{39}_b$, thereby to be transported to a subsequent processing station.

For further folding the eight-page signatures into sixteen-page ones, there is provided a chopper folder 43 over the conveyor 42. The chopper folder 43 includes a folding blade $\mathbf{43}_a$ which acts on the successive eight-page signatures 41 on the conveyor 42 into sixteen-page ones. This folding into sixteen-page signatures requires that the web be previously perforated longitudinally somewhere between former 37 and cutter/folder mechanism 39.

Embodiment of the Invention

The construction of the folding station F as so far described with reference to FIG. 1 is conventional, and therein lies no feature of the instant invention. The invention particularly concerns means incorporated in the folding station F for longitudinally perforating the folded web W in order to enable the same to be subsequently cut and further folded twice as above into sixteen-page signatures. FIGS. 2–6 are all directed to show how such longitudinally perforating means are built into the folding station F.

Figure 2:
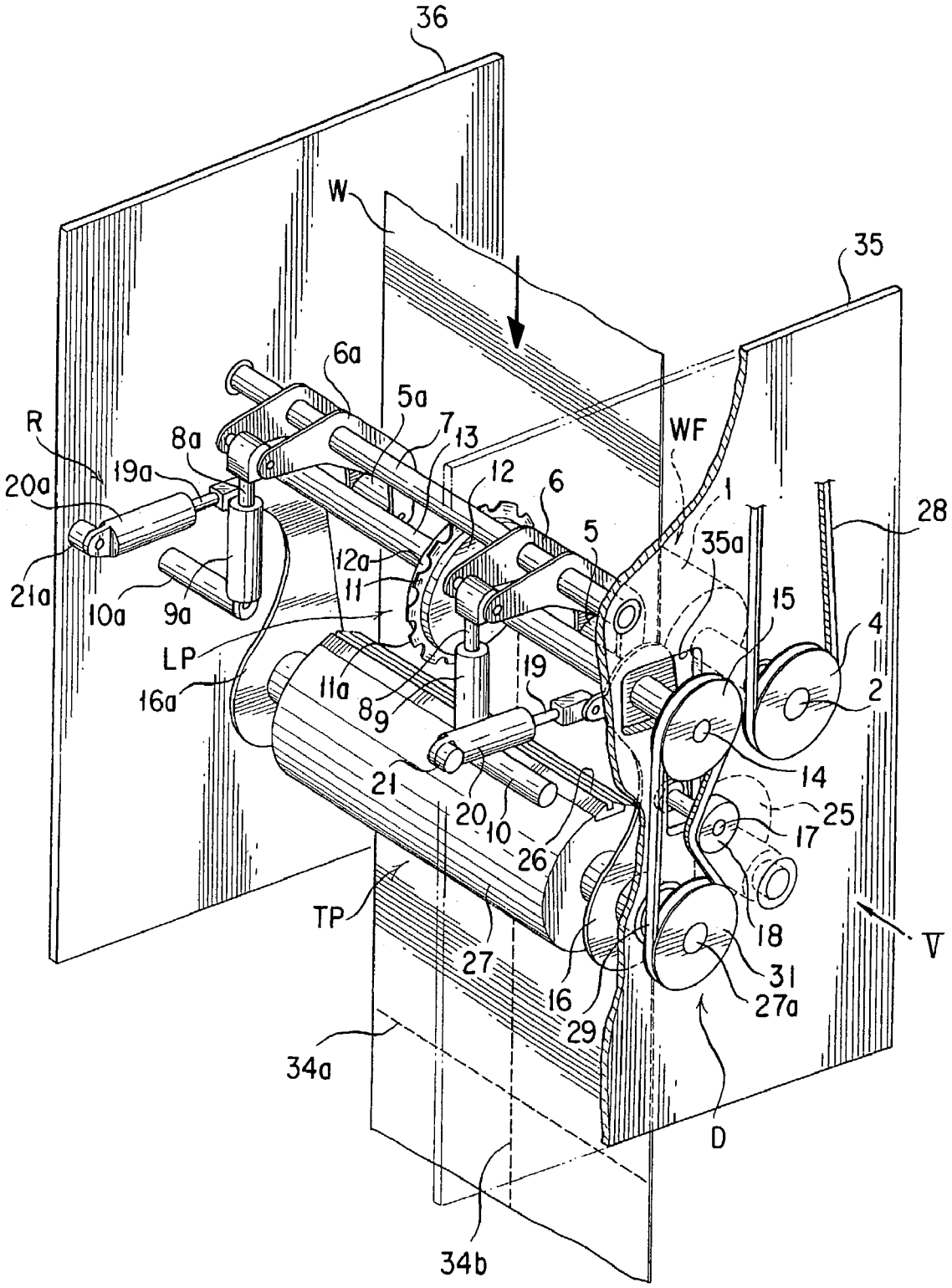
FIG. 2 is an enlarged perspective view, with a part shown broken away to reveal other parts, of part of the folding station incorporating a preferred form of longitudinal web perforator means according to the present invention.
Figure 3:
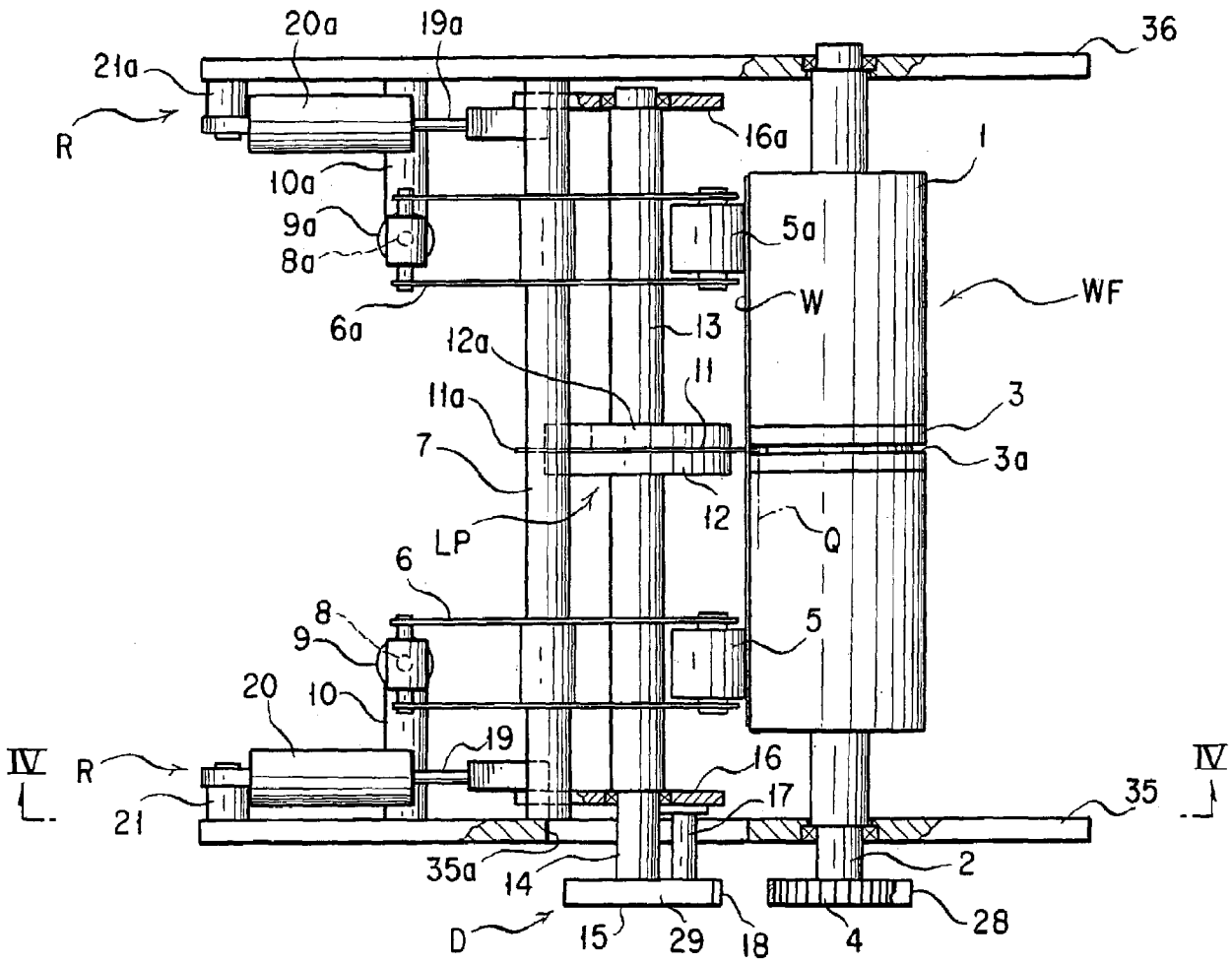
FIG. 3 is a top plan of the showing of FIG. 2.
Figure 4:
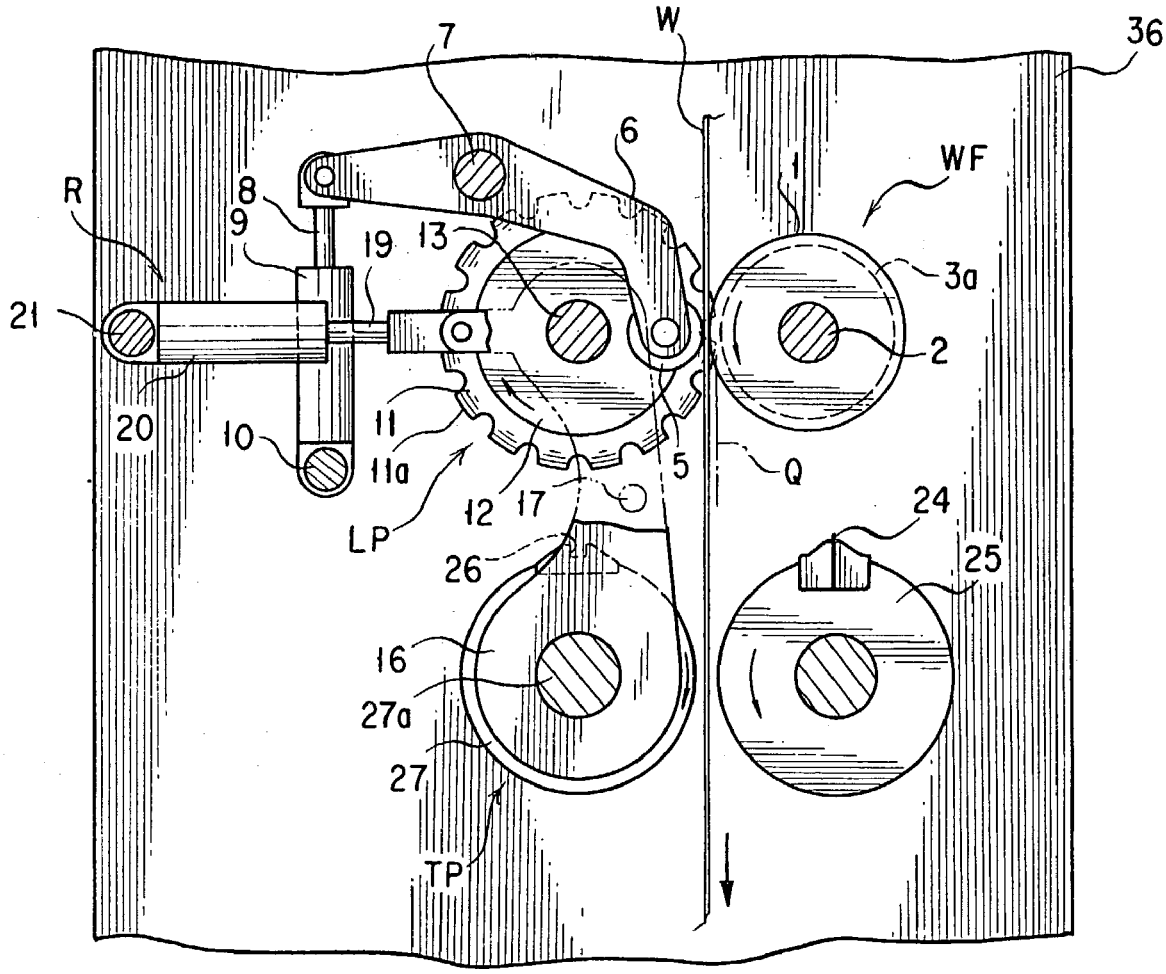
FIG. 4 is a vertical section taken along the line IV—IV in FIG. 3, showing the longitudinally perforating blade in its working position for perforating the web in cooperation with the anvil on the feed roller.

It will be observed from FIGS. 2–4 that the web W, previously doubled over itself by the former as in FIG. 1, is therein shown traveling down its predefined path between a pair of confronting framing walls 35 and 36. Mounted between these framing walls 35 and 36 are web feed means WF comprising a feed roller 1 and a pair of nip rollers 5 and $\mathbf{5}_a$ for feeding the web W downwardly. Transverse perforator means TP are conventionally provided downstream of the web feed means WF for cutting transverse rows of perforations $\mathbf{34}_a$, FIG. 2, in the web W at constant spacings. The transverse perforator mean TP include a blade cylinder 25 and anvil cylinder 27 on opposite sides of the predefined web path.

Positioned in close proximity of the web feed means WF are longitudinal perforator means LP forming the gist of this invention. For creating a longitudinal row of perforations $\mathbf{34}_b$, FIG. 2, centrally in the web W, the longitudinal perforator means LP include a sawtoothed perforating blade 11 and an anvil or bed 3 on the feed roller 1. The longitudinally perforating blade 11 rotates in synchronism with the transverse perforator means TP by being driven therefrom via drive linkage means seen at D in FIGS. 2, 3 and 5. Further the longitudinally perforating blade 11 is angularly displaceable by retractor means R into and out of perforating engagement with the web W. When retracted, the longitudinally perforating blade 11 permits the web W to be threaded between itself and the feed roller 1.

Hereinafter in this specification the above listed web feed means WF, transverse perforator means TP, longitudinal perforator means LP, drive linkage means D, and longitudinal perforator retractor means R will be explained in more detail, in that order and under separate headings. Comprehensive operational description will follow the detailed explanation of the listed means.

Web Feed Means

With reference to FIGS. 2–4 the web feed means include the feed roller 1 rotatably supported between the pair of framing walls 35 and 36, and the pair of nip rollers 5 and $\mathbf{5}_a$ for pressing the web W against the feed roller 1 in positions spaced axially of the feed roller. The feed roller 1 has a pair of trunnions projecting from its opposite ends and rotatably journaled in the framing walls 35 and 36. One of the trunnions has an extension projecting outwardly of the wall 35 and having a timing belt pulley 4 mounted fast thereon. A timing belt 28 extends over this pulley and a drive pulley, not shown, to impart rotation to the feed roller 1.

The pair of nip rollers 5 and $\mathbf{5}_a$ are rotatably mounted each at one end of a pair of parallel levers 6 or $\mathbf{6}_a$ (hereinafter referred to as the nip roller levers). Medially pivoted on a crossbeam 7 extending between the pair of walls 35 and 36, the two pairs of levers 6 and $\mathbf{6}_a$ have their other ends pivotally coupled respectively to the piston rods 8 and $\mathbf{8}_a$ of fluid-actuated cylinders 9 and $\mathbf{9}_a$ (hereinafter referred to as the nip roller cylinders). These nip roller cylinders 9 and $\mathbf{9}_a$ have their head ends pivotally coupled to brackets 10 and $\mathbf{10}_a$ on the walls 35 and 36, respectively, so that the pair of nip rollers 5 and $\mathbf{5}_a$ are angularly displaceable toward and away from the feed roller 1 with the extension and contraction of the nip roller cylinders.

It is understood that, upon extension of the nip roller cylinders 9 and $\mathbf{9}_a$ to cause retraction of the nip rollers 5 and $\mathbf{5}_a$, either the nip roller levers 6 and $\mathbf{6}_a$ or the nip roller cylinder piston rods 8 and $\mathbf{8}_a$ come into abutment against limit stops, not shown, on the framing walls 35 and 36 to limit the retraction of the nip rollers. The nip rollers 5 and $\mathbf{5}_a$ should be so retracted to such an extent as to be spaced from the feed roller 1 a sufficient distance for the web W to be threaded therethrough preparatory to printing. Then, upon contraction of the nip roller cylinders 9 and $\mathbf{9}_a$, the nip rollers 5 and $\mathbf{5}_a$ will travel back to their working position, urging the web W against the feed roller 1 under pressure from the nip roller cylinders. The web W will be frictionally fed downwardly through the folding station as the feed roller 1 is driven via the timing belt 28.

Transverse Perforator Means

Themselves conventional in the art, the transverse perforator means TP include the blade cylinder 25 and anvil cylinder 27 which are both rotatably supported by and between the pair of framing walls 35 and 36. The blade cylinder 25 underlies the feed roller 1, as best shown in FIG. 4, and the anvil cylinder 27 is positioned opposite the blade cylinder 25 via the web W. The blade cylinder 25 has mounted thereon a transversely perforating blade 24 extending parallel to the cylinder axis. The anvil cylinder 27 has formed thereon a grooved bed or anvil 26 for receiving the blade 24 on the blade cylinder 25 via the web W.

Thus, as the blade cylinder 25 and the anvil cylinder 27 rotate in the directions indicated by the arrows in FIG. 4, the web W will be perforated transversely at constant spacings. FIG. 2 shows at $\mathbf{34}_a$ one such row of transverse perforations that have been cut in the web W. It is understood that the blade cylinder 25 and anvil cylinder 27 are driven at the same peripheral velocity as the feed roller 1 in order to assure smooth travel of the web W.

Longitudinal Perforator Means

Reference may be had to FIGS. 2–4 and 6 for the following description of the longitudinal perforator means LP. Employed for creating the longitudinal row of perforations $\mathbf{34}_b$ in the web W as in FIG. 2 is the noted sawtoothed perforating blade 11 of annular shape concentrically mounted fast to a disclike blade holder 12 together with a blade retainer $\mathbf{12}_a$. The perforating blade 11 may be either of one-piece construction or a combination of two or more discrete sectors. The blade holder 12 is nonrotatably mounted to a blade carrier shaft 13 extending parallel to the feed roller 1. The blade carrier shaft 13 has its opposite ends rotatably journaled in bearings on a pair of swing arms 16 and $\mathbf{16}_a$ which are pivoted respectively on the pair of trunnions $\mathbf{27}_a$ of the anvil cylinder 27 of the transverse perforator means TP. The perforating blade 11 is therefore angularly displaceable with the carrier shaft 13 into and out of perforating engagement with the web W. Further the perforating blade 11 is to rotate with the blade carrier shaft 13 relative to the swing arms 16 and $\mathbf{16}_a$, by being driven by the drive linkage means D to be detailed subsequently.

The present invention makes use of the feed roller 1 as anvil cylinder against which the web W is perforated by the longitudinal perforating blade 11. To this end the feed roller has the aforesaid annular bed or anvil 3, complete with a groove $\mathbf{3}_a$ extending throughout its length, formed circumferentially on the feed roller surface for engaging the sawtoothed edge of the perforating blade 11.

The longitudinally perforating blade 11 has a series of rather blunt-ended teeth $\mathbf{11}_a$. The pitch of these teeth $\mathbf{11}_a$ is an integral submultiple of the distance between any two neighboring ones of the transverse perforations $\mathbf{34}_a$ created in the web W. The web will be perforated longitudinally as the toothed blade 11 incises the same on entering the groove $\mathbf{3}_a$ in the anvil 3 on the feed roller 1.

Drive Linkage Means

Figure 5:
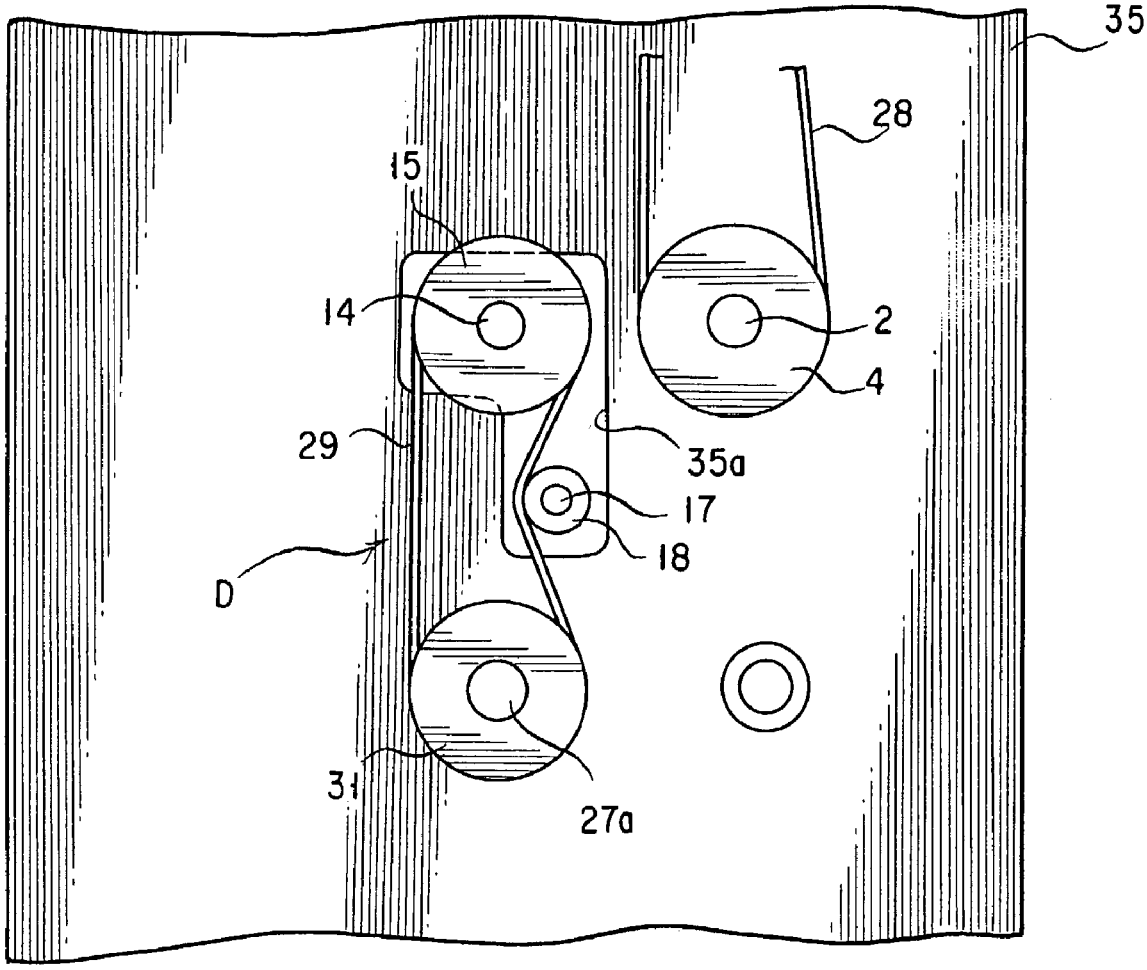
FIG. 5 is a side elevation of the showing of FIG. 2, seen in the direction of the arrow V therein.

The drive linkage means D from transverse perforator means TP to longitudinal perforator means LP appear in FIGS. 2, 3 and 5. Employed for driving the longitudinally perforating blade 11 in synchronism with the transversely perforating blade and anvil cylinders 25 and 27 is a timing belt 29 on the outside of the framing wall 35. The anvil cylinder 27 of the transverse perforator means TP has a trunnion $\mathbf{27}_a$ projecting outwardly of the framing wall 35. A timing belt pulley 31 is mounted fast on this projecting end of the trunnion $\mathbf{27}_a$. Another such pulley 15 is mounted fast on the extension 14 of the longitudinally perforating blade carrier shaft 13 which also projects outwardly of the framing wall 35. The timing belt 29 extends around these pulleys 15 and 31. The timing belt 29 is tensed by a tension pulley 18 on a shaft 17 which is cantilevered to one, 16, of the pair of swing arms 16 and $\mathbf{16}_a$ supporting the longitudinally perforating blade carrier shaft 13.

FIG. 5 best indicates that the framing wall 35 has an inverted-L-shaped slot $\mathbf{35}_a$ formed therein. Both the extension 14 of the longitudinally perforating blade carrier shaft 13 and the cantilever shaft 17 extend through this slot $\mathbf{35}_a$ with such clearance that the required pivotal motion of the pair of swing arms 16 and $\mathbf{16}_a$ is not in any way hampered by the drive means D.

It is understood that the anvil cylinder 27 of the transverse perforator means TP is itself conventionally driven at the same peripheral velocity as the traveling speed of the web F. This rotation of the anvil cylinder is transmitted via the timing belt 29 to the carrier shaft 13 and thence to the longitudinally perforating blade 11. The pulleys 15 and 31 are of the same diameter, tooth pitch, etc., so that the longitudinally perforating blade 11 will rotate at the same angular velocity as the anvil cylinder 27 of the transverse perforator means TP. Furthermore, the shortest distance between the axis of the longitudinally perforating blade 11 and the web W, when that blade is in the working position Q, FIGS. 3 and 4, is the same as that between the axis of the anvil cylinder 27 and the web.

Consequently, driven by the drive means D, the longitudinally perforating blade 11 will create longitudinal perforations $\mathbf{34}_b$ in prescribed positional relationship to the transverse perforations $\mathbf{34}_a$. The longitudinal perforations $\mathbf{34}_b$ are to come into exact register when, after being perforated transversely and horizontally, the doubled web is cut into individual sheets, and the sheets folded into eight-page signatures along the transverse perforations $\mathbf{34}_a$. When the eight-page signatures are subsequently folded along the longitudinal perforations $34_b$ into sixteen-page signatures, an adhesive may be impregnated through the longitudinal perforations which are registered at the folds, thereby bonding together all the pages of the signatures into book format.

The required positional relationship between transverse perforations $34_a$ and longitudinal perforations $34_b$ is obtainable if the noted distance between the axis of the longitudinally perforating blade 11 and the web W differs from that between the axis of the anvil cylinder 27 and the web. In this case the drive means D may be modified to include pulleys of such relative diameters and tooth numbers that the peripheral speed of the longitudinally perforating blade 11 matches that of the anvil cylinder 27.

Longitudinal Perforator Retractor Means

The longitudinally perforating blade 11 is nonrotatably mounted as aforesaid on the blade carrier shaft 13 which in turn is rotatably supported by and between the distal ends of the pair of swing arms 16 and $16_a$ on the pair of trunnions $27_a$ of the anvil cylinder 27 of the transverse perforator means TP. Pivotally coupled respectively to these swing arms 16 and $16_a$ are the piston rods 19 and $19_a$ of a pair of fluid-actuated cylinders 20 and $20_a$ which are seen in all of FIGS. 2–4 and 6. These cylinders 20 and $20_a$ will be hereinafter referred to as the longitudinal perforator cylinders in contradistinction from the nip roller cylinders 9 and $9_a$. The longitudinal perforator cylinders 20 and $20_a$ have their head ends pin-jointed to respective brackets 21 and $21_a$ on the framing walls 35 and 36.

Thus, with the extension and contraction of the longitudinal perforator cylinders 20 and $20_a$, the pair of swing arms 16 and $16_a$ will swing about the axis of the anvil cylinder 27 together with the longitudinally perforating blade 11. FIG. 4 shows the longitudinal perforator cylinders 20 and $20_a$ fully extended, with the longitudinally perforating blade 11 urged to the working position Q in which its teeth $11_a$ are received in the groove $3_a$ in the anvil 3 on the feed roller 1 after penetrating the web W. It is understood that limit stops, not shown, are provided for limiting the swinging motion of the swing arms 16 and $16_a$, or the extension of the longitudinal perforator cylinders 20 and $20_a$, when the longitudinally perforating blade 11 arrives at the working position Q.

Figure 6:
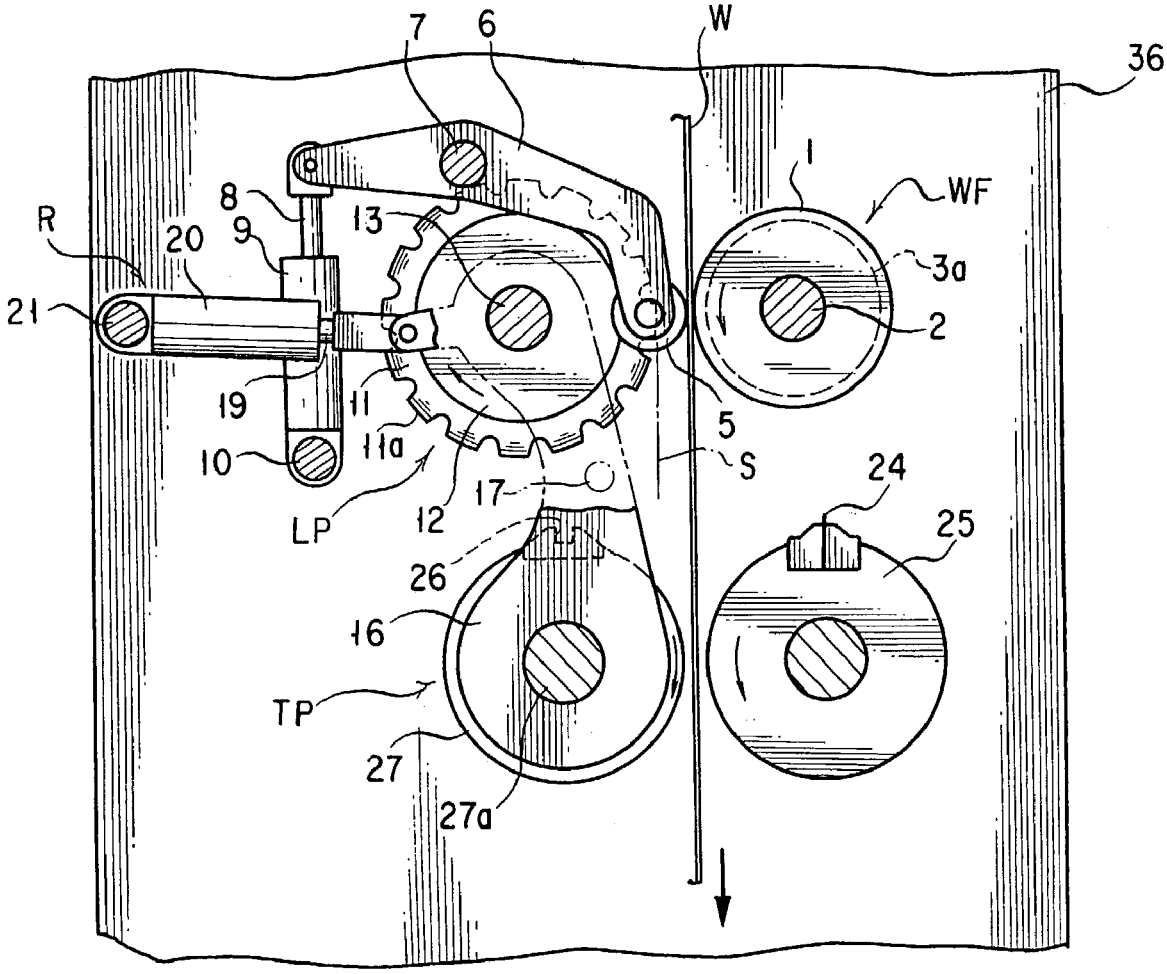
FIG. 6 is a view similar to FIG. 4 except that the longitudinally perforating blade is shown retracted away from the feed roller.

In FIG. 6 are shown the longitudinal perforator cylinders 20 and $20_a$ fully contracted to bring the longitudinally perforating blade 11 to the retracted position S, in which the blade is sufficiently spaced from the feed roller 1 for the web W to be threaded therebetween prior to printing. It is understood that limit stops, not shown, are also provided for limiting the swinging motion of the swing arms 16 and $16_a$, or the contraction of the longitudinal perforator cylinders 20 and $20_a$, when the blade 11 comes to the retracted position S.

For such travel of the longitudinally perforating blade 11 between working position Q and retracted position S, the longitudinal perforator cylinders 20 and $20_a$ may be placed in and out of communication with a pressurized fluid source and a fluid drain, both not shown, as by a solenoid valve. The solenoid valve is controllerable by an electric switch to be manipulated by the operator.

Operation

The longitudinally perforating blade 11 must be retracted as in FIG. 6 for threading the web W through the folding station, and through the complete printing press, preparatory to printing. To this end the pair of longitudinal perforator cylinders 20 and $20_a$ may be contracted thereby causing the pair of swing arms 16 and $16_a$ to turn from their FIG. 4 position to that of FIG. 6. The pair of nip rollers 5 and $5_a$ must also be retracted out of rolling engagement with the feed roller 1. This retraction is possible by extending the pair of nip roller cylinders 9 and $9_a$. The longitudinally perforating blade 11 may be retracted earlier than the pair of nip rollers 5 and $5_a$, in order that the longitudinally perforating blade carrier shaft 13 may not interfere with the retraction of the nip rollers.

Following the completion of web threading, the nip roller cylinders 9 and $9_a$ may both be contracted thereby urging the nip rollers 5 and $5_a$ against the feed roller 1 via the web W. As the printing press is subsequently set into operation, the printed web W will be fed into and through the folding station by the web feed means WF. The transverse perforator means TP will conventionally operate to create the transverse rows of perforations $34_a$ in the web W at constant spacings longitudinally of the web.

The operator may switch the unshown solenoid valve to cause extension of the longitudinal perforator cylinders 20 and $20_a$. Thereupon the pair of swing arms 16 and $16_a$ will travel from their FIG. 6 position to that of FIG. 4 thereby carrying the longitudinally perforating blade 11 into perforating engagement with the anvil 3 on the feed roller 1 via the web W. The blade 11 will then start perforating the web longitudinally. The longitudinal row of perforations $34_b$ will extend through one of the spaces between the transverse rows of perforations $34_a$.

Notwithstanding the foregoing detailed disclosure it is not desired that the present invention be limited by the exact showing of the drawings or the description thereof. A variety of modifications or alterations will suggest themselves to one skilled in the art on the basis of this disclosure. Let us consider for example one of the most important functional features of the invention, that is, that the longitudinally perforating blade 11 is retractable independently of the pair of nip rollers 5 and $5_a$. This objective is achieved in the illustrated embodiment by mounting the blade 11 on the blade carrier shaft 13 rotatably supported by and between the pair of swing arms 16 and $16_a$. The same goal is attainable in various other ways such as by eccentrically mounting the blade carrier shaft 13 to the nip roller shaft 7 via a pair of eccentric bearings thereon.

These and other modifications, substitutions and changes are intended in the foregoing disclosure. It is therefore appropriate that the present invention be construed broadly and in a manner consistent with the fair meaning or proper scope of the claims which follow.

What is claimed is:

1. An apparatus for both transversely and longitudinally perforating a paper web at a folding station of a web-fed printing press, comprising:

(a) feed means including a feed roller for feeding the web into and through the folding station;

(b) transverse perforator means for creating series of perforations transversely in the web, the transverse perforator means including a blade cylinder extending along a first transverse axis for rotation thereabout and an anvil cylinder for making perforating engagement with the blade cylinder via the web and extending along a second transverse axis for rotation thereabout;

(c) a longitudinally perforating blade carrier shaft rotatably supported opposite the feed roller and operative to pivot about the second transverse axis;

(d) a longitudinally perforating blade mounted to the longitudinally perforating blade carrier shaft for joint rotation therewith;

(e) an anvil formed on the feed roller for engaging the longitudinally perforating blade on the longitudinally perforating blade carrier shaft via the web in order to enable the longitudinally perforating blade to create a series of perforations longitudinally in the web;

(f) longitudinally perforating blade retractor means for pivotably moving the longitudinally perforating blade together with the longitudinally perforating blade carrier shaft about the second transverse axis into and out of perforating engagement with the anvil on the feed roller; and (g) drive linkage means for drivingly linking the transverse perforator means to the longitudinally perforating blade carrier shaft for synchronous rotation.

2. The perforating apparatus of claim 1 wherein the transverse perforator means comprises:

(a) a transversely perforating blade cylinder having a transversely perforating blade thereon; and (b) an anvil cylinder disposed opposite the transversely perforating blade cylinder, the anvil cylinder having an anvil formed thereon for engaging the transversely perforating blade on the transversely perforating blade cylinder via the web being thereby perforated transversely.

3. The perforating apparatus of claim 2 wherein the drive linkage means is coupled between the anvil cylinder of the transverse perforator means and the longitudinally perforating blade carrier shaft.

4. The perforating apparatus of claim 1 wherein the longitudinally perforating blade retractor means comprises:

(a) frame means;

(b) a pair of swing arms proximally coupled to the frame means for pivotal motion relative to the same and having the longitudinally perforating blade carrier shaft rotatably supported between distal ends thereof; and (c) actuator means acting between the frame means and the pair of swing arms for causing the pivotal motion of the latter relative to the former.

5. An apparatus for longitudinally perforating a paper web at a folding station of a web-fed printing press, comprising:

(a) a feed roller;

(b) a pair of nip rollers for feeding the web into and through the folding station in coaction with the feed roller, the pair of nip rollers having rotational axes parallel to a rotational axis of the feed roller, respectively;

(c) nip roller retractor means for moving the pair of nip rollers into and out of web-feeding engagement with the feed roller and parallel to the rotational axis of the feed roller;

(d) a blade carrier shaft opposite the feed roller;

(e) a longitudinally perforating blade mounted to the blade carrier shaft and disposed between the pair of nip rollers;

(f) an anvil formed on the feed roller for engaging the longitudinally perforating blade via the web being thereby perforated, the anvil having a periphery in common with the feed roller; and (g) blade retractor means for moving the longitudinally perforating blade together with the blade carrier shaft into and out of perforating engagement with the anvil on the feed roller, (h) wherein the longitudinally perforating blade is movable toward and away from the feed roller independently of the pair of nip rollers, and (i) wherein the rotational axis of the feed roller, the rotational axes of the nip rollers, the blade carrier shaft, a contacting position between the web and the periphery common to the feed roller and the anvil, contacting positions between the nip rollers and the web and a center position of an incising portion of the longitudinally perforating blade in the web are substantially in one horizontal plane while the rotational axes of the nip rollers are disposed between the blade carrier shaft and the web when the pair of nip rollers are in contact with the web on the feed roller and the longitudinally perforating blade incises the web on the anvil.

* * * * *